US007395938B2

(12) United States Patent
Merit et al.

(10) Patent No.: US 7,395,938 B2
(45) Date of Patent: Jul. 8, 2008

(54) METHOD AND APPARATUS FOR SELECTIVE ENGAGEMENT OF SHELF DIVIDER STRUCTURES WITHIN A SHELF MANAGEMENT SYSTEM

(75) Inventors: Jo A. Merit, 575 Esplaced, #106, Redondo Beach, CA (US) 90277; Jeff L. Harlan, Corona, CA (US)

(73) Assignees: Jo A. Merit, Palos Verdes Estates, CA (US); William Merit, Palos Verdes Estates, CA (US)

( * ) Notice: Subject to any disclaimer, the term of this patent is extended or adjusted under 35 U.S.C. 154(b) by 457 days.

(21) Appl. No.: 11/061,410

(22) Filed: Feb. 18, 2005

(65) Prior Publication Data

US 2006/0186064 A1 Aug. 24, 2006

(51) Int. Cl.
*A47F 1/04* (2006.01)

(52) U.S. Cl. ..... 211/59.4; 211/184

(58) Field of Classification Search ..... 211/59.2–59.4, 211/184; 312/61, 71

See application file for complete search history.

(56) References Cited

U.S. PATENT DOCUMENTS 1,190,964 A 7/1916 Snyder et al.

(Continued)

FOREIGN PATENT DOCUMENTS

EP 270016 6/1988

(Continued)

OTHER PUBLICATIONS

FFr Yellow Pages 2003 Product Catalog, "Merchandising Ideas Made Easy For Every Reail Environment!", Cover page, 9-11, 48-49, 52-58, Back Cover.

(Continued)

*Primary Examiner*—Jennifer E. Novosad
(74) *Attorney, Agent, or Firm*—MacPherson Kwok Chen & Heid LLP; Alan H. MacPherson

(57) ABSTRACT

Apparatus and method for selectively engaging and securing an array of shelf dividers to a mounting device which is securable to a display shelf. In the first form a divider is characterized by a divider structure having an elongated vertical wall and elongated horizontal base that operates to divide, organize and support the displayed merchandise. A resilient latch located on the underside of the base of the divider structure selectively engages and secures the divider structure onto a mounting device comprising a receiving member running longitudinally along the length of the surface of the mounting device which is securable along the front edge of a display shelf. The latch and the receiving member each comprise reciprocating (i.e. complementary) protrusions to allow the cooperative engagement of the divider structure and mounting device, thus locking the divider member to and unlocking the divider member from the mounting device to permit the repositioning of the display as desired without necessitating removal of the merchandise from the display. In addition when the divider structure and mounting device are fully engaged, a second protrusion on the underside of the divider member cooperates with a flange or lip on the mounting device to prevent lateral movement of the divider structure and maintain the position of the divider perpendicular to the mounting device and the front edge of the shelf. In a second embodiment, the divider structure comprises a pusher track and a spring urged pusher assembly to automatically push merchandise to the front of the shelf. Another embodiment comprises a divider base without a vertical divider wall, and with or without a pusher track and spring urged pusher assembly, thus pushers and dividers can be used in various convenient combinations within a shelf management system.

5 Claims, 10 Drawing Sheets

U.S. PATENT DOCUMENTS

| | | | |
|---|---|---|---|
| 1,800,075 | A | 4/1931 | Imrie |
| 1,971,749 | A | 8/1934 | Hamilton |
| 2,079,754 | A | 5/1937 | Waxgiser |
| 2,516,122 | A | 7/1950 | Hughes |
| 2,608,777 | A | 9/1952 | Schuler |
| 2,652,154 | A | 9/1953 | Stevens |
| 2,678,045 | A | 5/1954 | Erhard |
| 2,688,409 | A | 9/1954 | Echlin |
| 2,730,825 | A | 1/1956 | Wilds |
| 2,933,195 | A | 4/1960 | Radek |
| 2,934,212 | A | 4/1960 | Jacobson |
| 2,954,878 | A | 10/1960 | Metzler et al. |
| 3,038,067 | A | 6/1962 | Dench et al. |
| 3,161,295 | A | 12/1964 | Chesley |
| 3,167,187 | A | 1/1965 | Sarkisian |
| 3,295,690 | A | 1/1967 | Ottman |
| 3,308,961 | A | 3/1967 | Chesley |
| 3,452,899 | A | 7/1969 | Libberton |
| 3,702,508 | A | 11/1972 | Netter |
| 3,751,129 | A | 8/1973 | Wright et al. |
| 3,814,490 | A | 6/1974 | Dean et al. |
| 3,868,021 | A | 2/1975 | Heinrich |
| 3,872,976 | A | 3/1975 | Moore et al. |
| 4,042,096 | A | 8/1977 | Smith |
| 4,062,302 | A | 12/1977 | Krizan |
| 4,064,813 | A | 12/1977 | Hewett et al. |
| 4,106,668 | A | 8/1978 | Gebhardt et al. |
| 4,269,326 | A | 5/1981 | Delbrouck |
| 4,300,693 | A | 11/1981 | Spammer |
| 4,303,162 | A | 12/1981 | Suttles |
| 4,346,806 | A | 8/1982 | Bustos |
| 4,351,439 | A | 9/1982 | Taylor |
| 4,364,481 | A | 12/1982 | Ricci |
| 4,378,872 | A | 4/1983 | Brown |
| 4,395,955 | A | 8/1983 | Pfeifer |
| 4,460,096 | A | 7/1984 | Ricci |
| 4,488,653 | A | 12/1984 | Belokin |
| 4,503,982 | A | 3/1985 | Lewis |
| 4,595,105 | A | 6/1986 | Gold |
| 4,615,276 | A | 10/1986 | Garabedian |
| 4,685,574 | A | 8/1987 | Young |
| 4,712,694 | A | 12/1987 | Breslow |
| 4,724,968 | A | 2/1988 | Wombacher |
| 4,730,741 | A | 3/1988 | Jackle, III et al. |
| 4,735,324 | A | 4/1988 | Wilcek |
| 4,750,625 | A | 6/1988 | Frederick |
| 4,762,236 | A | 8/1988 | Jackle, III et al. |
| 4,775,058 | A | 10/1988 | Yatsko |
| 4,792,051 | A | 12/1988 | Miller |
| 4,801,025 | A | 1/1989 | Flum |
| 4,809,856 | A | 3/1989 | Muth |
| 4,811,851 | A | 3/1989 | Shane |
| 4,830,201 | A | 5/1989 | Breslow |
| 4,896,779 | A | 1/1990 | Jureckson |
| 4,907,707 | A | 3/1990 | Crum |
| 4,942,968 | A | 7/1990 | Fast |
| 5,012,936 | A | 5/1991 | Crum |
| 5,085,154 | A | 2/1992 | Merl |
| 5,111,942 | A | 5/1992 | Bernardin |
| 5,148,927 | A | 9/1992 | Gebka |
| 5,161,702 | A | 11/1992 | Skaski |
| 5,161,704 | A | 11/1992 | Valiulis |
| 5,190,186 | A | 3/1993 | Yablans et al. |
| 5,199,584 | A | 4/1993 | Fowler et al. |
| 5,203,463 | A | 4/1993 | Gold |
| 5,217,124 | A | 6/1993 | Stone |
| 5,255,802 | A | 10/1993 | Krinke et al. |
| 5,265,738 | A | 11/1993 | Yablans et al. |
| 5,341,945 | A | 8/1994 | Gibson |
| 5,351,839 | A | 10/1994 | Beeler et al. |
| 5,366,099 | A | 11/1994 | Schmid |
| 5,381,890 | A | 1/1995 | Scobbie |
| 5,381,908 | A | 1/1995 | Hepp |
| 5,390,802 | A | 2/1995 | Pappagallo et al. |
| 5,413,229 | A | 5/1995 | Zuberbuhler et al. |
| 5,450,969 | A | 9/1995 | Johnson et al. |
| 5,458,248 | A | 10/1995 | Alain |
| 5,464,105 | A | 11/1995 | Mandeltort |
| 5,469,976 | A | 11/1995 | Burchell |
| 5,475,604 | A | 12/1995 | Nagamatsu |
| 5,562,217 | A | 10/1996 | Salveson et al. |
| 5,613,621 | A | 3/1997 | Gervasi |
| 5,634,564 | A | 6/1997 | Spamer et al. |
| 5,638,963 | A | 6/1997 | Finnelly et al. |
| 5,664,689 | A | 9/1997 | Mirlisena, Sr. |
| 5,665,304 | A | 9/1997 | Heinen et al. |
| 5,673,801 | A | 10/1997 | Markson |
| 5,682,824 | A | 11/1997 | Visk |
| 5,690,038 | A | 11/1997 | Merit et al. |
| 5,730,320 | A | 3/1998 | David |
| 5,738,019 | A | 4/1998 | Parker |
| 5,743,428 | A | 4/1998 | Rankin, VI |
| 5,746,328 | A | 5/1998 | Beeler et al. |
| 5,775,523 | A | 7/1998 | Teringo |
| 5,803,276 | A | 9/1998 | Vogler |
| 5,836,097 | A | 11/1998 | Lewis et al. |
| 5,839,588 | A | 11/1998 | Hawkinson |
| 5,971,173 | A | 10/1999 | Valiulis et al. |
| 6,006,678 | A | 12/1999 | Merit et al. |
| 6,041,720 | A | 3/2000 | Hardy |
| 6,082,557 | A | 7/2000 | Leahy |
| 6,129,218 | A | 10/2000 | Henry et al. |
| 6,142,317 | A | 11/2000 | Merl |
| 6,142,323 | A | 11/2000 | Veil, Sr. et al. |
| 6,164,215 | A | 12/2000 | Cook et al. |
| 6,227,385 | B1 | 5/2001 | Nickerson |
| 6,234,328 | B1 | 5/2001 | Mason |
| D445,615 | S | 7/2001 | Burke |
| 6,299,004 | B1 * | 10/2001 | Thalenfeld et al. ..... 211/184 |
| 6,305,559 | B1 | 10/2001 | Hardy |
| 6,357,606 | B1 | 3/2002 | Henry |
| 6,382,431 | B1 | 5/2002 | Burke |
| 6,409,027 | B1 | 6/2002 | Chang et al. |
| 6,409,028 | B2 | 6/2002 | Nickerson |
| 6,464,089 | B1 | 10/2002 | Rankin, VI |
| 6,484,891 | B2 | 11/2002 | Burke |
| 6,497,326 | B1 * | 12/2002 | Osawa ..... 211/59.2 |
| 6,527,127 | B2 | 3/2003 | Dumontet |
| 6,533,131 | B2 | 3/2003 | Bada |
| D472,411 | S | 4/2003 | Burke |
| 6,622,874 | B1 | 9/2003 | Hawkinson |
| 6,655,536 | B2 | 12/2003 | Jo et al. |
| 6,666,533 | B1 | 12/2003 | Stavros |
| D485,699 | S | 1/2004 | Mueller et al. |
| 6,705,477 | B1 | 3/2004 | Narkis et al. |
| 6,772,888 | B2 | 8/2004 | Burke |
| 6,796,445 | B2 * | 9/2004 | Cyrluk ..... 211/183 |
| 6,822,943 | B1 | 11/2004 | Mantin |
| 7,216,770 | B2 * | 5/2007 | Mueller et al. ..... 211/59.3 |
| 2001/0010302 | A1 | 8/2001 | Nickerson |
| 2002/0108916 | A1 * | 8/2002 | Nickerson ..... 211/59.3 |
| 2002/0170866 | A1 | 11/2002 | Johnson et al. |
| 2003/0057167 | A1 | 3/2003 | Johnson et al. |
| 2003/0085187 | A1 | 5/2003 | Johnson et al. |
| 2003/0141265 | A1 | 7/2003 | Jo et al. |
| 2003/0217980 | A1 | 11/2003 | Johnson et al. |
| 2004/0118794 | A1 | 6/2004 | Hardy |
| 2004/0140278 | A1 | 7/2004 | Mueller et al. |
| 2004/0140279 | A1 | 7/2004 | Mueller et al. |
| 2004/0173546 | A1 | 9/2004 | Nagel |
| 2004/0245197 | A1 | 12/2004 | McElvaney |
| 2005/0056602 | A1 | 3/2005 | Hardy |
| 2005/0077260 | A1 | 4/2005 | Mueller et al. |
| 2005/0092702 | A1 | 5/2005 | Nagel |

2005/0092703 A1 5/2005 Mueller et al.
2006/0201897 A1* 9/2006 Mueller et al. ..... 211/59.3

FOREIGN PATENT DOCUMENTS

| | | |
|---|---|---|
| EP | 986980 | 3/2000 |
| FR | 2617385 | 1/1989 |
| GB | 2027339 | 2/1980 |
| GB | 2290077 | 12/1995 |
| JP | 59-218113 | 12/1984 |
| WO | WO 02/091885 | 11/2002 |

OTHER PUBLICATIONS

ImageWorks Display & Marketing Group Point of Purchase Displays, p. 1 of 1; Apr. 2, 2005; http://www.imageworksdisplay.com/whoweare.htm.
MTM System, Modular Tobacco Merchandising, pp. 1-2; Apr. 2, 2005, http//www.mtmsystem.com.
MTM System, Adjustable Tobacco Pusher Kit, pp. 1-3; Apr. 2, 2005, http://www.mtmsystem.com/MTM4.htm.
MTM System, Cabinets and mtm/*R.J.Reynolds Components, pp. 1-4; Apr. 2, 2005, http://www.mtmsystem.com/MTM2.htm.

* cited by examiner

METHOD AND APPARATUS FOR SELECTIVE ENGAGEMENT OF SHELF DIVIDER STRUCTURES WITHIN A SHELF MANAGEMENT SYSTEM

FIELD OF THE INVENTION

The present invention relates to retail display divider structures and to a structure and method for conveniently securing same to store shelves. More particularly, this invention relates to retail display structures which may be easily reorganized without necessitating the removal of the retail merchandise from the display.

BACKGROUND OF THE INVENTION

In any merchandising scheme success in selling requires a constant modification of the goods offered for sale while maintaining a neatly organized display. The style, selection and assortment of goods in stores and the display mechanisms for displaying these goods are continuously changing. For these reasons, various prior art shelf organizing structures include the ability to rearrange the dividers within a display. Devices of this type are described in U.S. Pat. No. 5,690,038 issued Nov. 25, 1997, and U.S. Pat. No. 6,006,678 issued Dec. 28, 1999, to Merit. Merit teaches a divider structure that snaps onto a split tube to secure the divider structure to the mounting device attached to a shelf; however, the divider must be rotated ninety degrees to release and remove it from the mounting device to adjust or relocate the divider structure along the mounting device.

Moreover, generally sellers desiring to maximize product sales have increased the number of articles displayed within a given space, thereby significantly limiting the ability of store personnel to conveniently move, change or restock the merchandising display scheme. Prior art U.S. Pat. No. 4,830,021 issued May 16, 1989 to Breslow and U.S. Pat. No. 6,041,720 issued Mar. 28, 2000 to Hardy, teach that while some dividers slide easily along an extrusion attached to a shelf, there is no means to lock them in place. Consequently, as articles are emptied from the shelf the display is prone to disarray. Other prior art disclosed by Hardy in published International Application No. PCT/US02/15760 teaches a divider that couples to a mounting member utilizing mating teeth; however, the divider must be removed from the extrusion before it can be repositioned. The teeth lock the divider in place, but do not allow for conveniently repositioning the divider absent removing the displayed articles and the dividers from the shelf. This is inconvenient, labor intensive and expensive for stores because even the slightest adjustment can require removing the articles from the shelf to reposition the dividers, then reloading the articles.

SUMMARY OF THE INVENTION

Accordingly, one purpose and object of this invention is to overcome the shortcomings of the prior art by providing a latching and locking mechanism for a divider structure, a combination divider and spring urged pusher structure, or a divider base, which allows convenient engagement, release and re-engagement of the relevant structure to a mounting member that is securable to the front edge of a shelf without necessitating removal of the displayed articles from the shelf, thus saving on the time and expense of labor to perform this function.

In one embodiment, a latching and locking mechanism is provided that is simple in use and convenient in fabrication.

This latching and locking mechanism holds the divider and/or base structure in place relative to the mounting member and thus prevents lateral movement of the divider and/or base structure along the mounting member attached to the shelf.

In another embodiment, one or more additional base structures are provided to expand the width of a divider base to accommodate increasing widths of displayed articles. The base structures are of varying widths and each base structure can use the latching and locking mechanism of the invention to prevent lateral movement of the base relative to the mounting member attached to the shelf.

This invention allows shelves to be placed close, one above the other, in a store thereby to obtain maximum display area for the display of products to be sold while at the same time allowing the widths of the articles to be displayed to be adjusted without having to physically remove the divider structures from the shelves. As a feature of this invention, it is possible to reposition a divider laterally along a shelf merely by pressing down on a resilient extension (i.e. a resilient "latch") from the divider base to unlock the base from the mounting member, push back on the divider to remove the latch from a slot in the mounting member, slide the divider and base laterally left or right along the shelf until the new position of the divider is reached, and then pull the divider and base forward to reinsert the latch from the base into a slot on the mounting member and cause a protrusion on the extension from the base to catch (i.e. lock) against another protrusion on a surface of the slot in the mounting member. Consequently, a divider can be repositioned along a shelf without having to lift the divider vertically. This means that the bottom of the shelf above the divider can be very close to the top of the divider and yet not interfere with the repositioning of the divider along the shelf. This allows the divider to be repositioned with minimum time and effort and without removing the articles stored adjacent the divider and allows more articles to be displayed in a given area.

Other benefits of the invention will become apparent from the following description in conjunction with the accompanying drawings.

DETAILED DESCRIPTION

Figure 1:
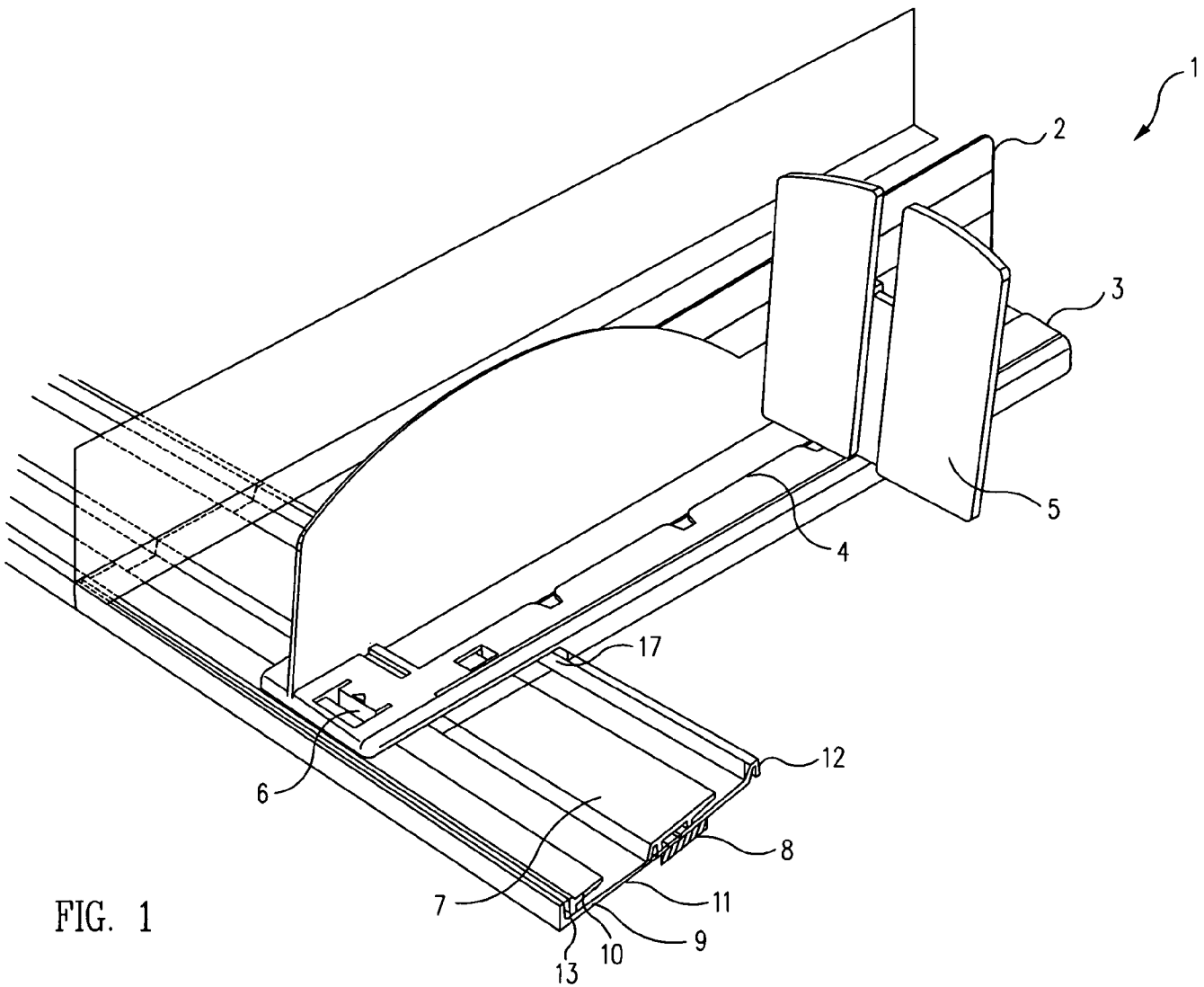
FIG. 1 is a top perspective view illustrating a shelf divider structure in a shelf management system according to the present invention.

Referring now to the drawings, shown are several illustrative, but not limiting, embodiments of the divider structure of the shelf management system according to the present invention.

Figure 3:
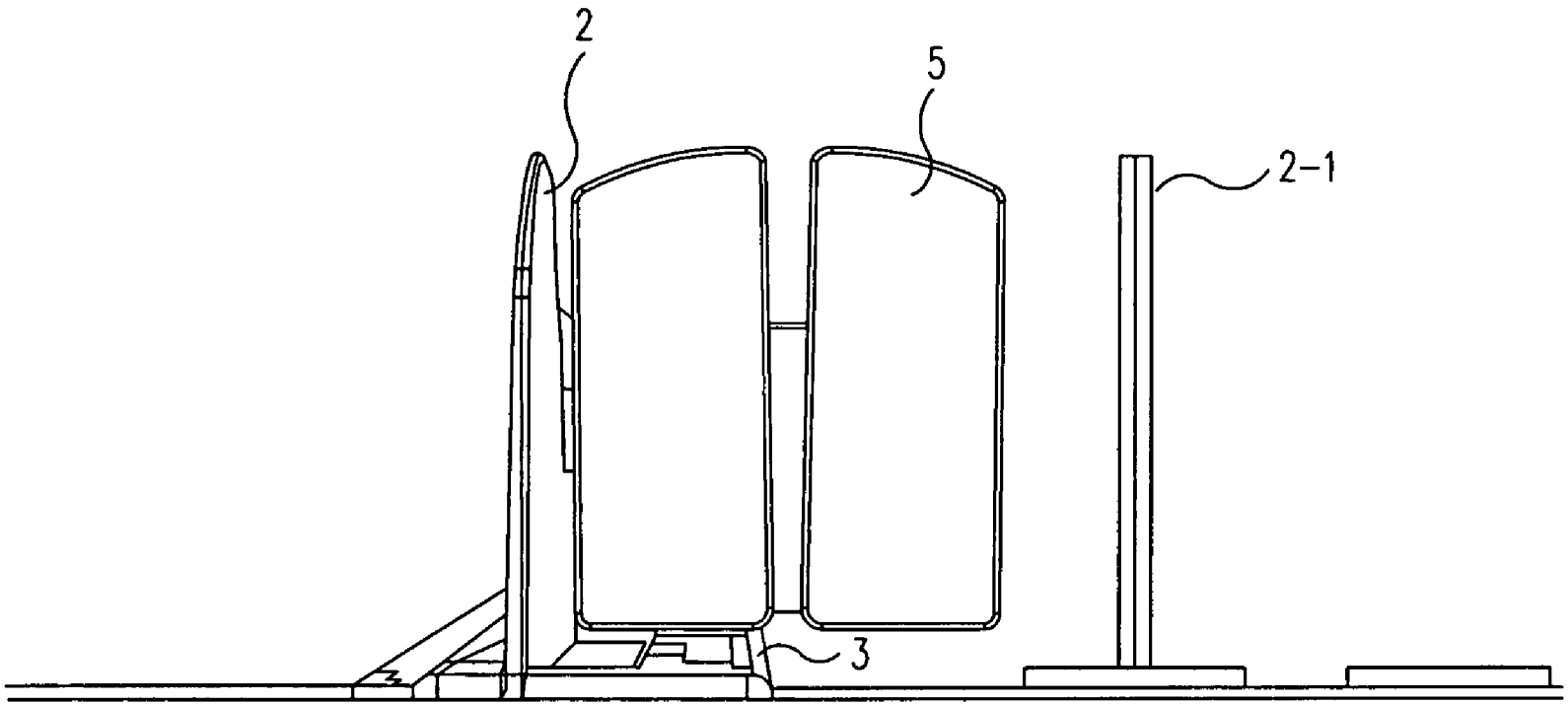
FIG. 3 is a front elevation view of a plurality of shelf divider structures of a shelf management system according to the present invention.
Figure 4:
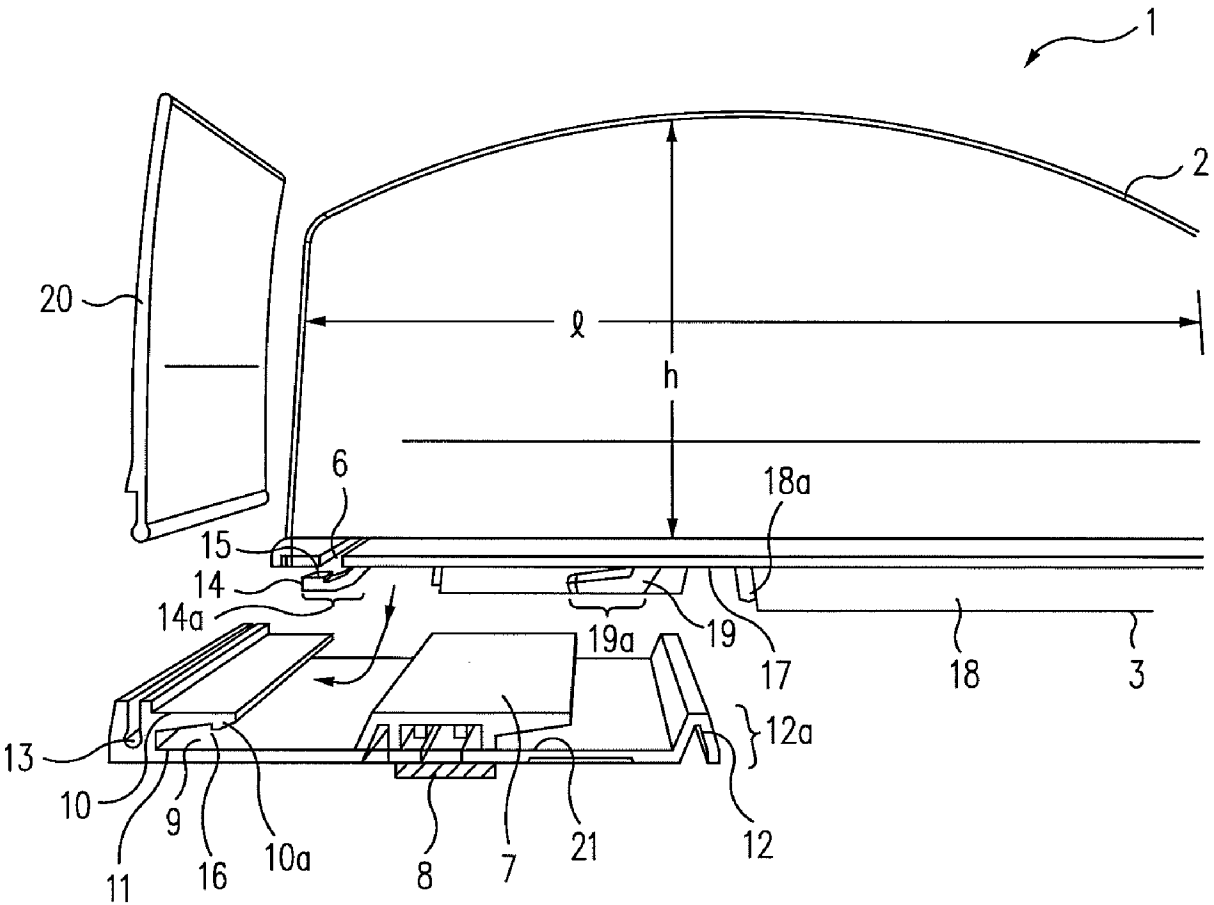
FIG. 4 is a side exploded view illustrating a disengaged divider member and mounting member of a shelf management system according to the present invention.
Figure 5A:
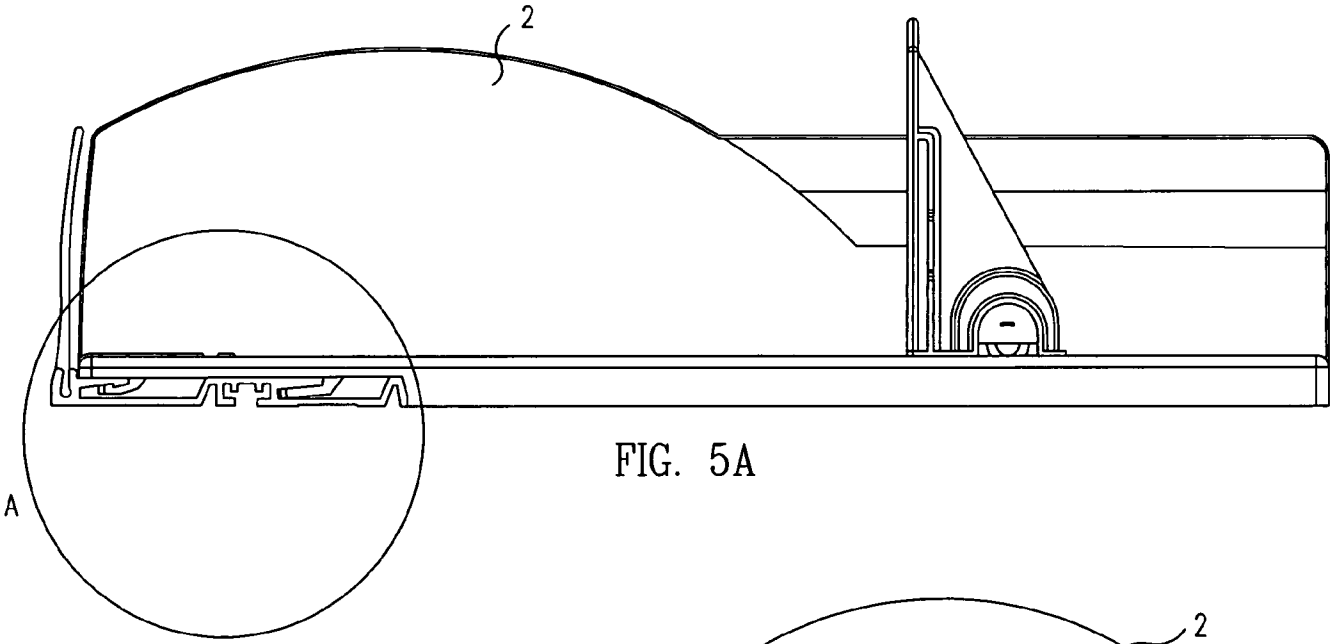
FIG. 5A is a side exploded view illustrating an engaged divider member and mounting member of a shelf management system according to the present invention.
Figure 5B:
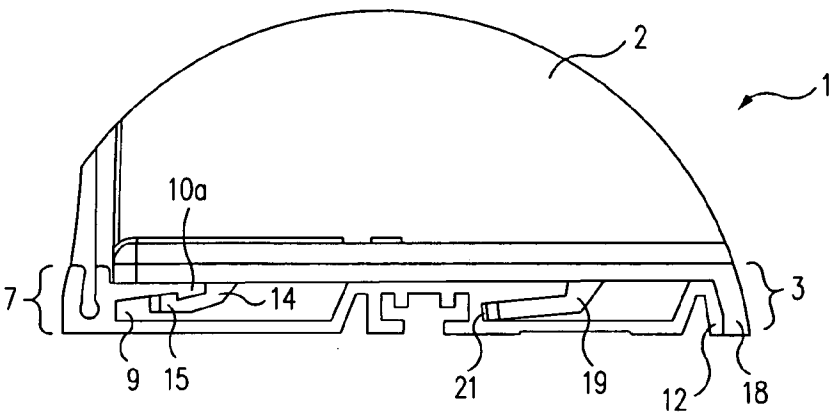
FIG. 5B is an enlarged view of a portion of the side exploded view of FIG. 5A illustrating an engaged divider base member and mounting member of a shelf management system according to the present invention.

FIGS. 1 and 4 show a first embodiment of a divider system 1, comprising a vertical divider wall 2, and horizontal divider base 3. The terms "vertical" and horizontal" are used herein to illustrate the relative orientation of system components in the figures but it should be understood that in use these components may be oriented on shelves which slope and thus are other than perfectly horizontal. Base 3 includes an "L" shaped extension (sometimes called a latch 14) with a protrusion 15 (not shown in FIG. 1 but shown in FIG. 4) and a recess 17 (FIG. 4) which cooperatively engage with and lock onto a generally horizontal mounting member 7. Mounting member 7 is attached to a shelf (not shown for simplicity in FIGS. 1 and 3 through 7 but shown as 22 in FIG. 8). Member 7 includes a horizontal receiving slot 9 defined in part by an upper portion 10 fitted with a protrusion 10*a* and defined further by a lower surface 11 of the bottom plate of member 7. Receiving slot 9 receives a portion 14*a* of "L" shaped extension 14 attached to base 3. Portion 14*a* of extension 14 has a protrusion 15 which when portion 14*a* is inserted into slot 9, mates with protrusion 10*a* as shown in FIG. 5B to hold divider 2 and base 3 in place relative to mounting member 7. A vertical flange or lip 12 (shown as "A" shaped in FIG. 4) is arranged to have its right-most side 12*a* in direct contact with two surfaces 18*a* of two side flanges 18 of base 3. For simplicity only one side flange 18 and one surface 18*a* are numbered in FIG. 4 but as shown in FIG. 7, base 3 has two side flanges 18 with two surfaces 18*a* which contact surface 12*a* when base 3 is fully engaged with mounting member 7. The friction between surfaces 18*a* of flanges 18 and surface 12*a* of lip 12 helps prevent divider 2 from moving laterally along member 7 and also prevents divider 2 from "fishtailing"; that is from having the right portions of divider 2 and base 3 (FIG. 4) pivot or rotate in a horizontal plane about extension 14. Such "fishtailing" can occur when a shopper extends an arm along divider system 1 to try to reach a package behind the front most package, or when store personnel are stocking products. Divider 2 is also shown having a height "h" and a length "1" to prevent a shopper from using an arm to "sweep" a plurality, if not all, of the arrayed product on base 3 and beside divider 2 from the shelf. Such sweeping is often employed by shoplifters.

As shown in FIGS. 4 and 5B, lip 12 is received in recess 17 in base 3 when divider 2 is in place on mounting member 7. FIGS. 5A and 5B show the relationship between base 3 and mounting member 7 when divider 2 and base 3 are locked into mounting member 7. The mounting member 7 is operationally attached to a shelf 22 (not shown in FIGS. 4, 5A or 5B but shown in FIGS. 2 and 8), with adhesive tape 8, or any other suitable means of attachment, such as a screw and nut or clip. FIG. 9 shows mounting member 7 attached to a shelf 22 by a bolt 23.

Figure 2:
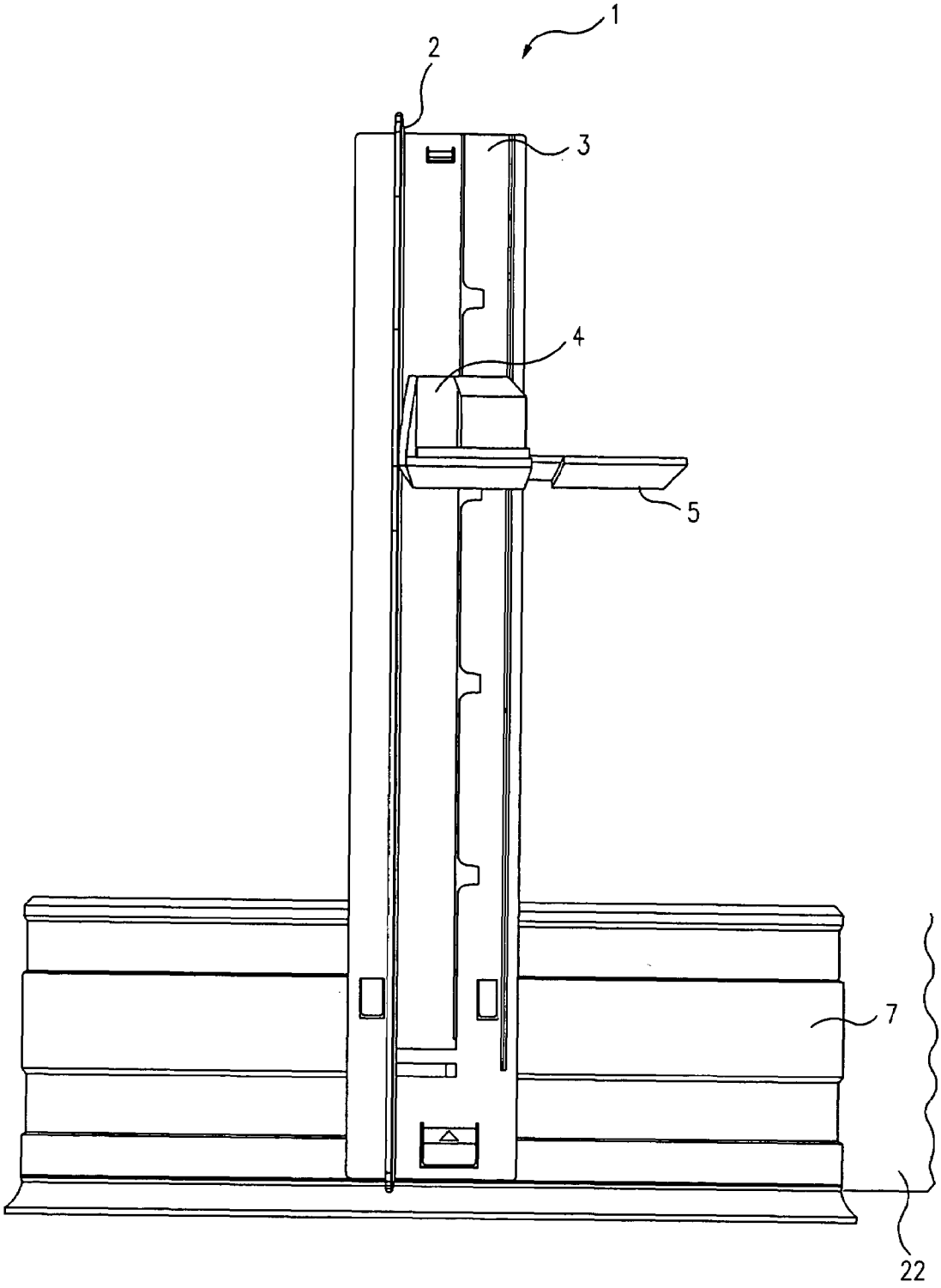
FIG. 2 is a plan view of a shelf divider structure of a shelf management system according to the present invention.

FIG. 2 shows a top view of the structure shown in FIG. 1. For simplicity, not all the numbers in FIG. 1 have been applied to FIG. 2 but in particular, shown in top view is the divider system 1 which has the vertical divider member 2 attached to a base 3 and a pusher 5. Pusher 5 is able to slide along base 3 in a manner well known in the art, to cause the articles stacked or arrayed in front of pusher 5 to move along base 3 toward the front of the shelf 22 to which mounting number 7 is attached whenever a shopper takes the front most article from the shelf. Spring 4 provides, in a well known manner, the force to pusher 5 which then is applied by pusher 5 to the array of articles to move the articles along base 3 toward the front of the shelf 22 each time an article is removed from the shelf.

FIG. 3 shows a front isometric view of the divider 2, base 3 and pusher 5, arrayed along base 3 together with an adjacent divider 2-1 to the right of divider 2. As will be understood, a plurality of dividers will be used on any shelf. An advantage of this invention is that the dividers 2 can be laterally moved along the shelf easily, in a manner to be described below, and without having to remove all the articles stored adjacent each divider.

FIG. 4, which has been referred to above in conjunction with the description of the structure shown in FIG. 1, shows in more detail and in cross-sectional exploded view the structure of this invention. As has been discussed above, resilient and flexible portion 14*a* of "L" shaped extension 14 attached to base 3 is designed to enter slot 9 with the protrusion 15 on portion 14*a* rising up and locking the base plate 3 in the mounting member 7 when portion 14*a* is inserted fully into slot 9. Referring to FIG. 1 and FIG. 4, an opening 6 is provided in the front of base 3 to allow a clerk, or another person, to place fingers in the opening and push down on portion 14*a* of extension 14. When this is done, divider 2 and base 3 are easily slid back (to the right in FIGS. 1 and 4) away from the front of the shelf and then can be laterally moved along the shelf to allow a different sized article to be displayed using divider 2 and base 3. The structure is then returned to a locked position by pulling divider 2 and base 3 forward into mounting member 7 and to the front of the shelf (to the left in FIGS. 1 and 4) causing portion 14*a* of extension 14 to enter slot 9. Because "L" shaped extension 14 is flexible and elastic, typically made of a resilient plastic but capable of being made of any other appropriate resilient material, the portion 14*a* of extension 14 is forced downward as the base 3 is slid toward the front of the shelf to allow protrusion 15 on extension 14 to pass beneath protrusion 10*a* of slot 9. Once protrusion 15 is to the left of protrusion 10*a*, portion 14*a* of extension 14 snaps upward vertically causing protrusion 15 to be held in position by protrusion 10*a*, on extension 10, of the mounting member 7, thereby locking base 3 and divider 2 in position.

Slot 13 in mounting member 7 holds a baffle plate 20 which prevents articles from being pushed off the shelf by spring 4 acting on pusher plate 5 (FIG. 2) and on which can be placed sales information, such as the identification of the article, the price, the price per unit weight, the source, or any other desired information to be displayed adjacent to the articles. Baffle plate 20 can be any appropriate size but preferably allows a shopper to see a substantial part of the article behind the plate.

As shown in FIG. 4, at least one second extension 19 extends downward from base 3 and includes horizontal portion 19*a* which goes into substantially horizontal slot 21 associated with mounting member 7. Slot 21 receives extension 19*a* as divider 2 and base 3 are slid forward to be locked into place on mounting member 7. A-shaped lip 12 resides in recess 17 during the placement of divider 2 and base 3 in position on mounting member 7. As divider 2 and base 3 are moved to the front of the shelf (i.e. to the left in FIG. 4), the surface 12*a* of A-shaped lip 12 comes into physical contact with surfaces 18*a* of flanges 18 which are part of base 3. A corresponding flange 18 with a surface 18*a* on the back side of base 3 is just barely visible in the perspective view of FIG. 4. This other surface 18*a* (not numbered in FIG. 4 to avoid drawing clutter but shown and numbered in FIG. 7) also contacts surface 12*a* of lip 12. The two surfaces 18*a* in contact with surface 12*a* on lip 12 prevent "fishtailing" of, or lateral movement of, divider 2 and base 3 about extension 14 (i.e. about the front portion of the shelf).

FIG. 5A shows in more detail the latching and locking structure of one embodiment when divider 2 is mounted on base 3 and extension 14 is fully inserted in slot 9, such that protrusion 15 on extension 14 locks in place base 3 on mounting member 7, which in turn is attached to a shelf (not shown). The protrusion 15 has snapped upward to engage with protrusion 10*a* and thus lock base 3 in position relative to mounting member 7. In this position, surface 12*a* of lip 12 (FIGS. 4, 5A, 5B and 7) is in direct contact with the two surfaces 18*a* of flanges 18 on base 3. In an alternative embodiment, flanges 18 can be replaced by a solid volume of material 18, which runs from one side of base 3 to the other, or by any volume of material 18 as desired (i.e. spaces can be left between portions of material 18 as desired to save material). In any case, the surface(s) of this material 18 directly abutting surface 12*a* prevents fishtailing of divider 2 and base 3.

Figure 6A:
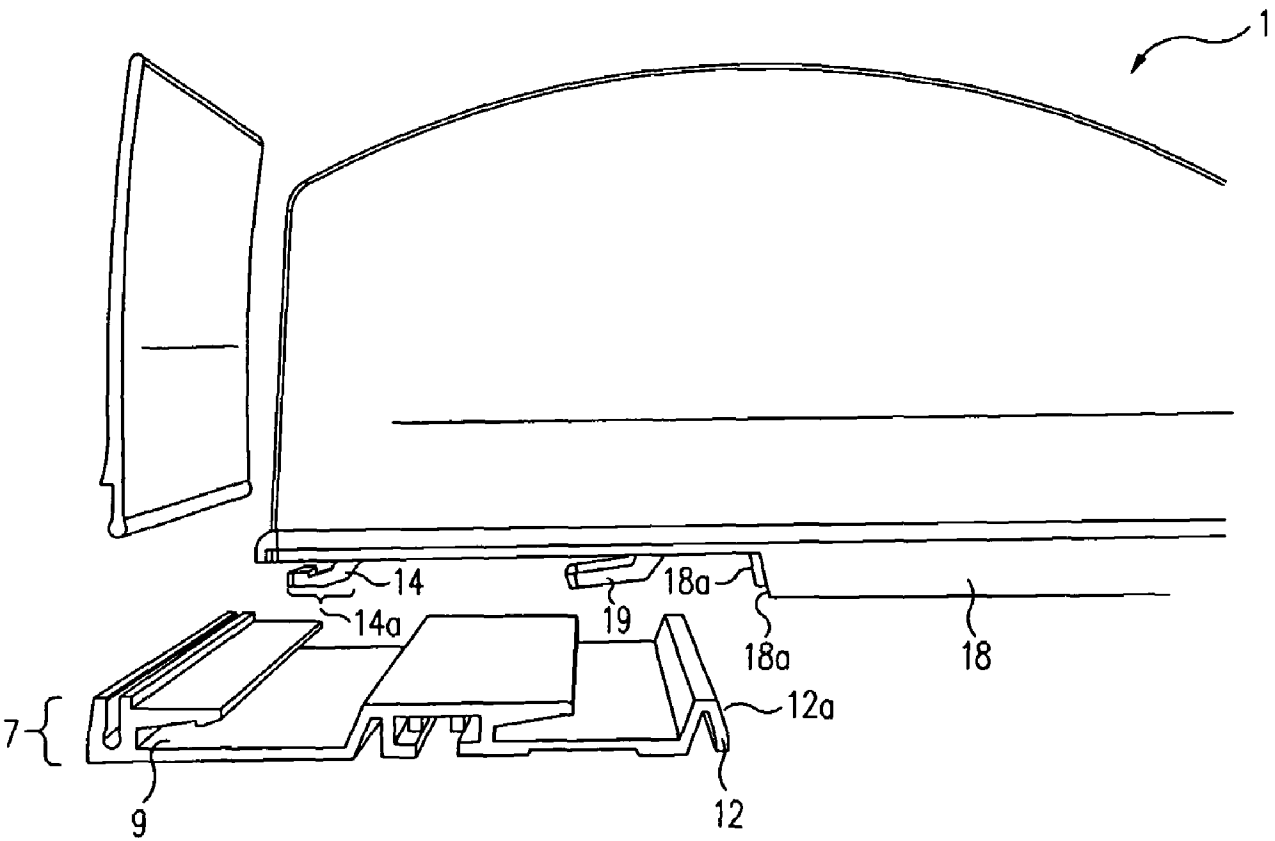
FIG. 6A is a perspective exploded view illustrating the method of disengaging and re-engaging a divider member and mounting member of a shelf management system according to the present invention.
Figure 6B:
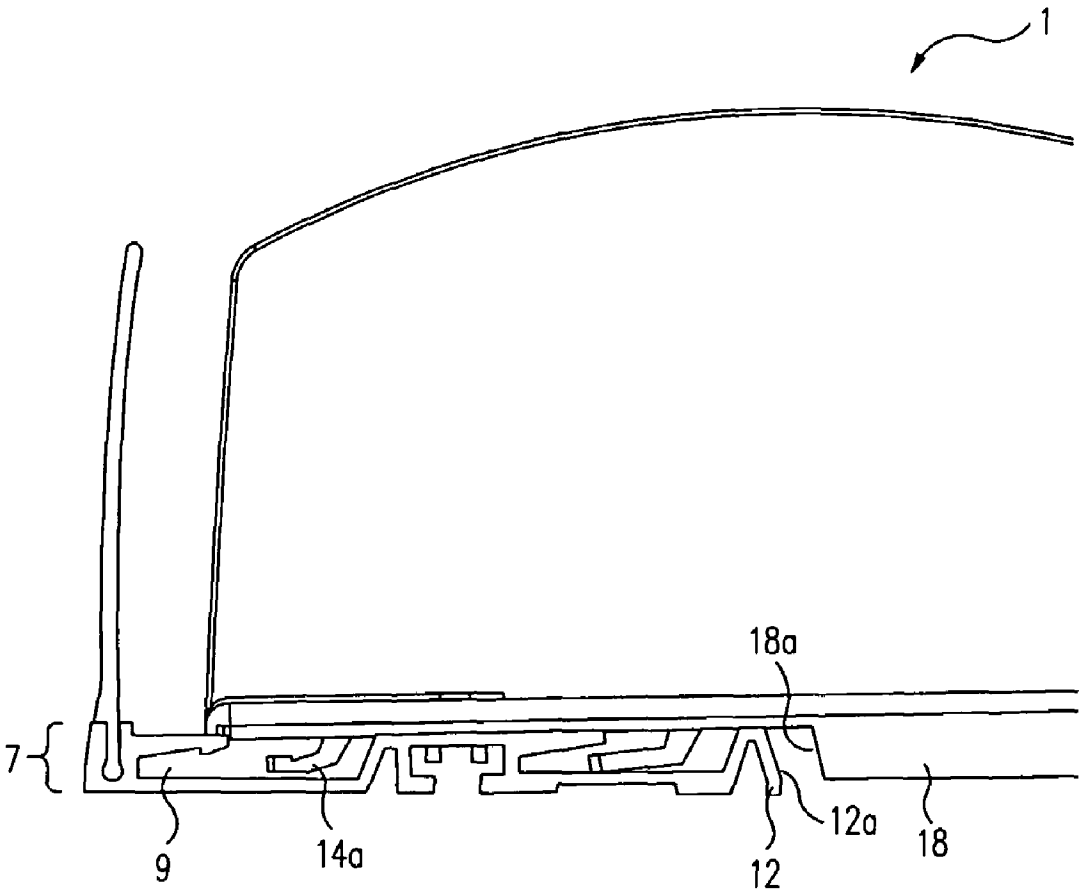
FIG. 6B is a perspective exploded view further illustrating the method of disengaging and re-engaging a divider base member and mounting member of a shelf management system according to the present invention.
Figure 7:
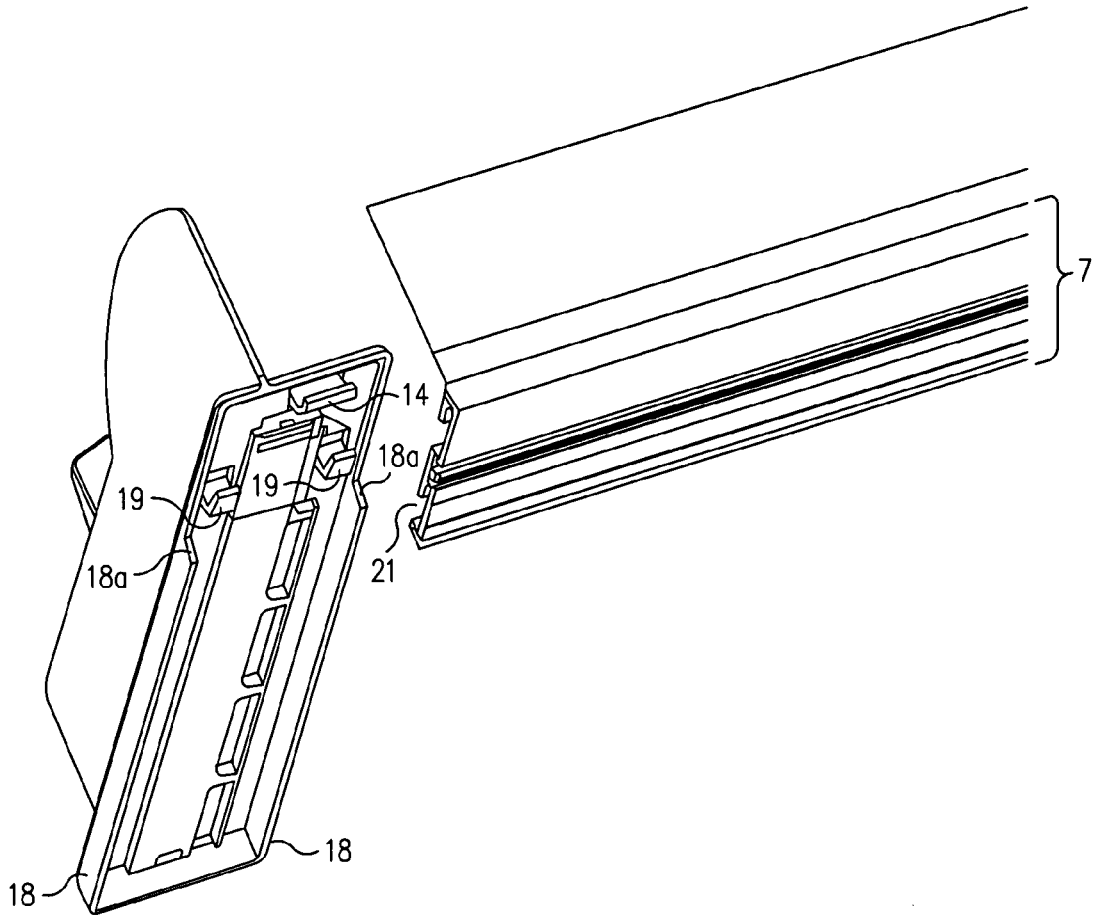
FIG. 7 is an underside perspective, exploded view of the structure of this invention showing the components of the latch and locking portions of this structure in relation to the mounting member 7.

FIG. 6A shows the divider 2 and base 3 above the mounting member 7, before divider 2 and base 3 have been placed in direct physical contact with the mounting member 7. FIG. 6B shows base 3 in contact with mounting member 7 but not yet pulled forward (to the left) so as to cause extension 14*a* of base 3 to be inserted into slot 9 associated with mounting member 7. Surfaces 12*a* and 18*a* are shown separated at this point in the mounting process. FIG. 5B then shows the structure of FIG. 6B fully engaged and locked in place on mounting member 7 with surfaces 12*a* and 18*a* directly in contact with each other.

FIG. 7 shows an isometric view of the bottom of the structure showing two surfaces 18*a* on flanges 18 associated with base 3, and showing the extension 14 before the structure has been placed on mounting member 7. For simplicity, other components have not been numbered in FIG. 7. However, the extensions 19 are shown as two separate extensions for insertion into the corresponding slots 21 associated with mounting member 7. In FIG. 5B the slots 21 are shown having received extensions 19.

Figure 8:
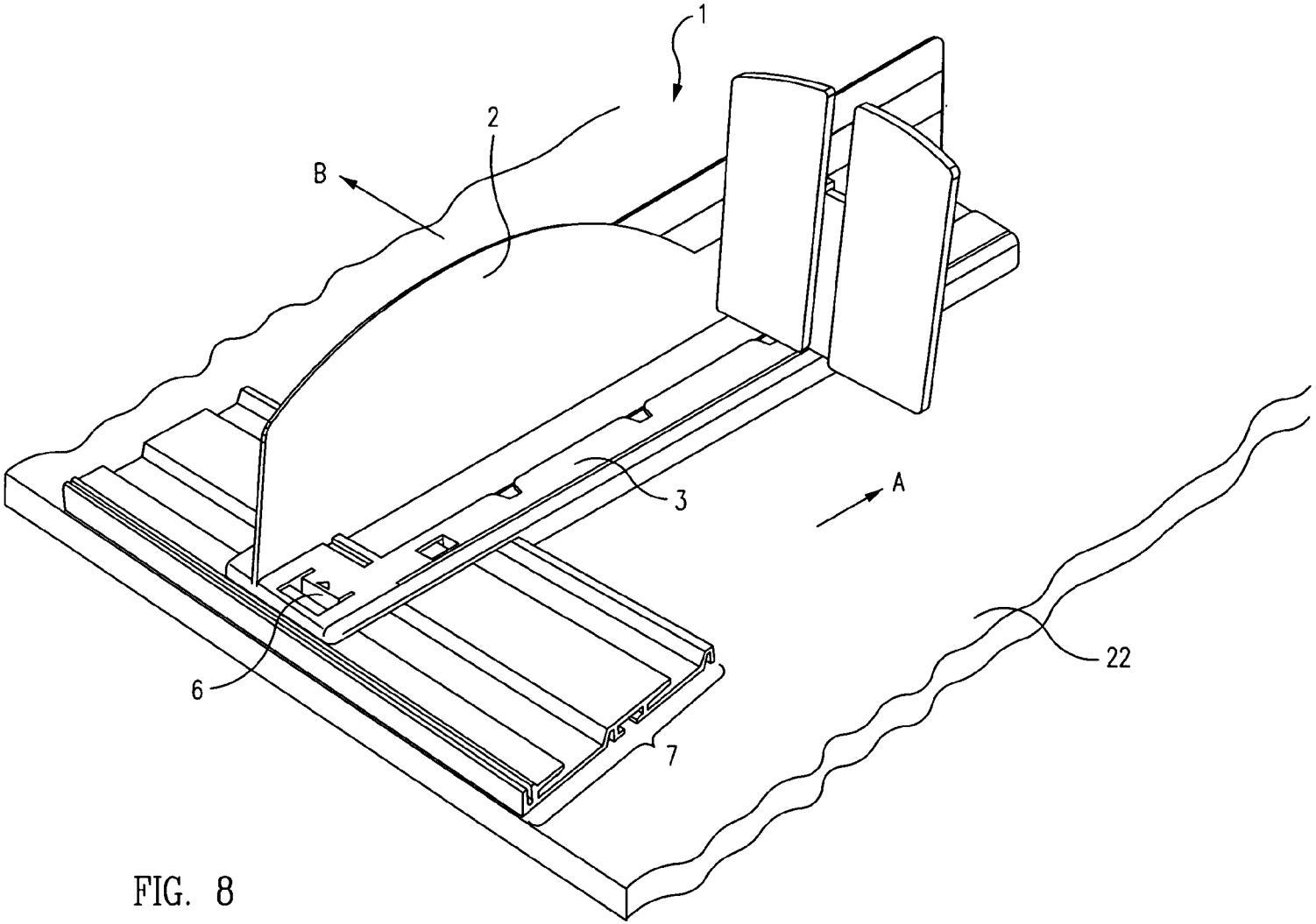
FIG. 8 is a perspective view of a divider 2 and base 3 using the latching and locking structure of this invention showing the opening 6 in the base 3 through which a person is able to unlock the base 3 from the mounting member 7 so as to be able to laterally move the divider 2 and base 3 along the shelf 22.
Figure 9:
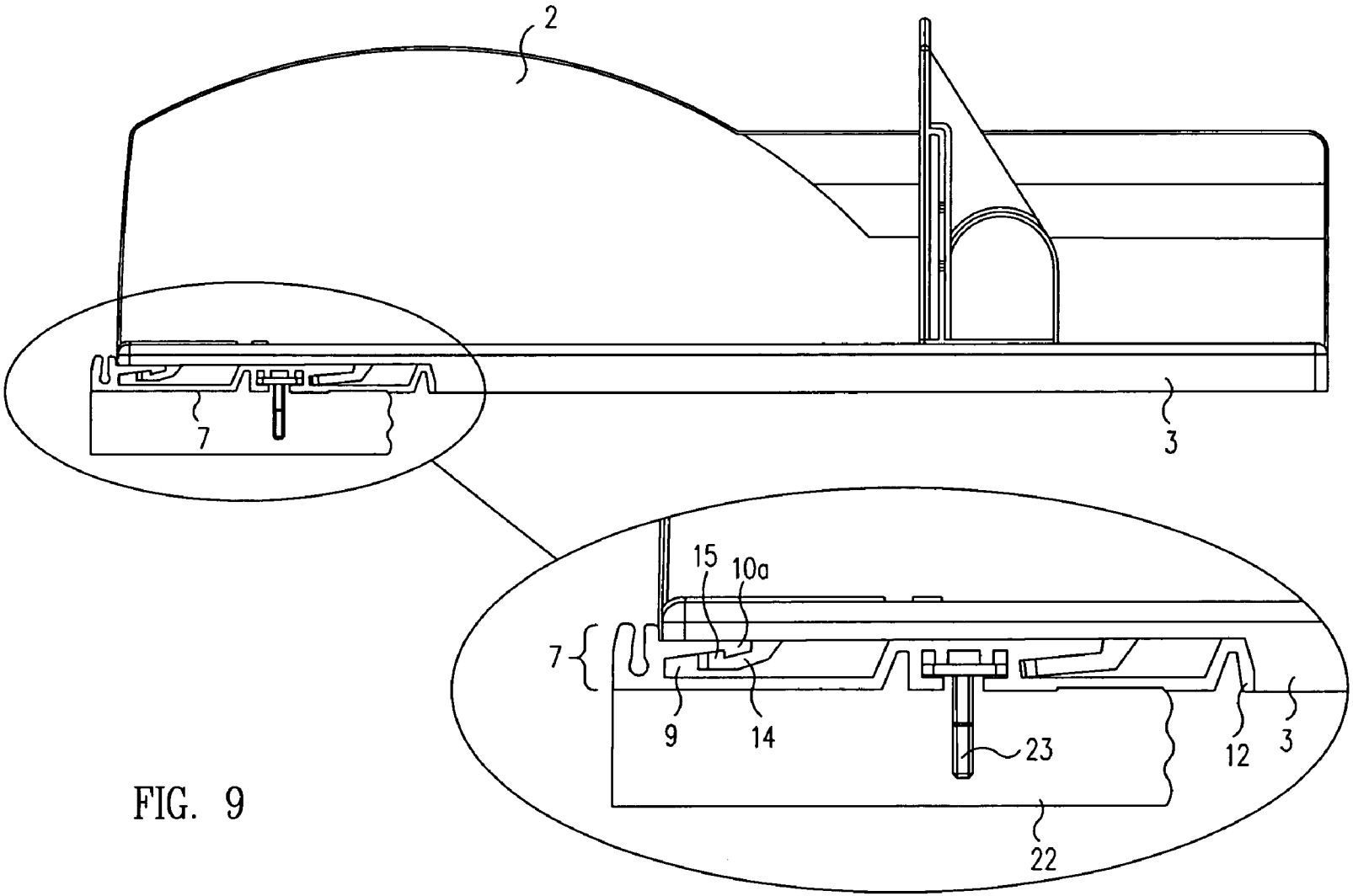
FIG. 9 is a side view of mounting member 7 showing a bolt used to attach member 7 to an underlying shelf.

FIG. 8 shows the embodiment of FIG. 1 with opening 6 in the front portion of base 3 for receiving a finger, or even a pencil of a clerk, for the purpose of pushing down on portion 14*a* of extension 14 to disengage the divider 2 from mounting member 7. By then pushing divider 2 gently in the direction "A", as shown by the arrow in FIG. 8, base 3 is unlocked from mounting member 7. Divider 2 and base 3 can then be moved laterally along the shelf 22 as shown by the arrow "B" in FIG. 8. While this arrow shows movement to the left, of course divider 2 and base 3 can be moved either left or right along the shelf as desired.

An advantage of this invention is that the divider system 1 can be reoriented laterally along the shelf without removing the articles stored on the shelf 22. Because shelf space is at a premium in stores, vertical lifting of the base 3 and divider 2 to allow these components to be moved laterally along shelf 22 to accommodate a different size package is not possible because most shelves are arranged to provide very little space between the articles on one shelf, and the bottom of the shelf above the articles. Accordingly, in this situation, vertical movement of divider 2 and base 3 to allow the divider 2 and base 3 to be moved along the shelf 22 is not feasible. An advantage of this invention is that the divider 2 and base 3 locks in place using predominantly horizontal motion, although some vertical motion is of course acceptable, and sometimes possible. However, if desired, the disclosed divider system is capable of being moved along the shelf to accommodate a different sized article with only horizontal motion. This is done by pressing down through opening 6 in base 3 (FIG. 1) on the portion 14*a* of extension 14 and sliding the base 3 and divider 2 back gently with protrusion 15 below and thus not blocked by protrusion 10*a*. Then the divider 2 and base 3 can be laterally moved left or right along the shelf and then pulled forward to lock the divider 2 and base 3 in position in its new location. If desired, finger holes can be proved in divider 2 to assist the store clerk in moving the base 3 and divider 2. All of this can be done without lifting vertically base 3 and divider 2.

As shown in FIGS. 4 and 5A, protrusion 15 of latch 14 cooperates with reciprocating protrusion 10*a* on the top surface of slot 9 to engage and help hold the divider 2 and base 3 in contact with the mounting member 7. When latch 14 is fully engaged with the reciprocating protrusion 10 of mounting member 7, flange 12 of mounting member 7 cooperates with recess 17 located on the underside of base 3 and flange surfaces 18*a* (FIG. 7) to prevent lateral movement and to lock the divider member in a position perpendicular to the front edge of the shelf 22 as shown in FIG. 2.

A divider member can be outfitted with an optional spring 4 urged pusher 5, referred to as a divider/pusher member 2, and engaged with mounting member 7 as described above with respect to FIG. 2. Additional divider members 2 or divider/pusher members similar to member 2 or serving the same function as member 2 can then be similarly engaged with and locked onto the mounting member 7 at desired locations along the mounting member 7 to accommodate the varying sizes and widths of retail merchandise using the structure and method of this invention.

An alternative embodiment places protrusion 10*a* on the bottom of slot 9 (FIG. 4) and places protrusion 15 on extension 14*a* attached to base 3 so as to lock base 3 to member 7 by engaging protrusion 15 with bottom-located protrusion 10*a*. A ring or other type of pull (such as a "T" member) is attached to extension 14*a* to allow extension 14*a* to be pulled up to release base 3 from member 7.

The advantages of the present invention include new and improved shelf management systems including a locking mechanism for divider structures or divider structures that include spring urged pushers. The disclosed shelf management systems maintain the alignment of the retail merchandise in neat rows on the shelf. The shelf management systems may be installed quickly or reorganized without the need for tools. Furthermore, embodiments of the present invention provide a locking mechanism for divider structures including but not limited to divider structures that include spring urged pushers to allow the display to be reorganized without the need to remove the retail merchandise from the shelf, thus improving functionality of the shelf management system. The preferred embodiments of the present invention can be used interchangeably to create a cohesive shelf management system that accommodates varying sizes and widths of retail merchandise.

The invention has been described with reference to several embodiments. Obviously, modifications and alterations will occur to others upon a reading and understanding of this specification. It is intended to include all such modifications and alterations insofar as they come within the scope of the appended claims and the equivalents thereof.

We claim:

1. A shelf divider system including:

a base having a bottom surface;

a mounting member for mounting securely to a shelf;

a first slot associated with said mounting member;

a first extension from the bottom surface of the base, said first extension being insertable into said first slot in said mounting member, said first slot being adapted to receive the first extension of said base;

a first protrusion on said first extension; and a second protrusion on a selected surface of said first slot, said second protrusion being adapted such that when said first extension is inserted into said first slot, said first protrusion mates with said second protrusion so as to lock said base to said mounting member;

a second slot in said mounting member:

at least one additional extension extending from the same side of the base as said first extension, said at least one additional extension being arranged so as to rest in said second slot when said first extension is inserted into said first slot so as to lock said base to said mounting member; and a divider attached to said base, said divider being capable of separating items on one side of the divider from items on the other side of the divider.

2. Structure as in claim 1 including: a recess formed in said base; and a lip formed on a portion of said mounting member, said lip being located so as to be extendable into said recess.

3. Structure as in claim 2 wherein said lip has a first surface which, when said base is locked to said mounting member, is in direct contact with at least one second surface at one end of said recess, thereby to securely lock said base relative to said mounting member to prevent rotational or lateral movement of said base relative to said mounting member.

4. Structure as in claim 3 including a shelf to which said mounting member is fixably attached.

5. Structure as in claim 1 including means for attaching said mounting member to a shelf.

* * * * *